US005497798A

United States Patent [19]

Fritz et al.

[11] Patent Number: 5,497,798

[45] Date of Patent: Mar. 12, 1996

[54] CONVEYOR DISHWASHER

[75] Inventors: Herbert D. Fritz, Blue Bell; Austin H. Rosenblum, Philadelphia, both of Pa.

[73] Assignee: Insinger Machine Company, Philadelphia, Pa.

[21] Appl. No.: 338,325

[22] Filed: Nov. 14, 1994

[51] Int. Cl.[6] ..... A47L 15/00; B08B 3/02

[52] U.S. Cl. ..... 134/151; 134/131

[58] Field of Search ..... 134/68, 72, 131, 134/151, 153

[56] References Cited

U.S. PATENT DOCUMENTS

| | | | |
|---|---|---|---|
| 1,896,149 | 2/1933 | Zademach | 134/68 |
| 1,908,617 | 5/1933 | Rodewald . | |
| 2,471,506 | 5/1949 | Wiswall | 134/153 X |
| 2,677,381 | 5/1954 | Fisher . | |
| 2,721,564 | 10/1955 | Kearney | 134/72 |
| 3,285,779 | 11/1966 | Dunham | 134/44 |
| 3,458,136 | 7/1969 | Belaieff | 239/227 |
| 4,257,559 | 3/1981 | Noren | 239/283 |
| 4,418,868 | 12/1983 | Gurubatham et al. | 239/228 |
| 4,434,012 | 2/1984 | Eckert et al. | 134/25.4 |
| 4,993,444 | 2/1991 | Toriyama et al. | 134/181 |
| 5,131,419 | 7/1992 | Roberts | 134/50 |
| 5,329,952 | 7/1994 | Kojima et al. | 134/133 |

FOREIGN PATENT DOCUMENTS

| | | | |
|---|---|---|---|
| 426128 | 6/1967 | Switzerland | 134/131 |

OTHER PUBLICATIONS

Insinger 100 Years of Service multi-page Brochure.
Insinger "CSI-11400" 1 page flyer.
"Introducing Insinger's New CrossFire™ Warewashing System" 1 page advertisement, front and back.
Insinger's "Drexel University Report" 1 page advertisement, front and back.
Insinger Dishwasher Assembly drawing.

*Primary Examiner*—Philip R. Coe
*Attorney, Agent, or Firm*—Howson and Howson

[57] ABSTRACT

A dishwasher for cleaning and sanitizing a commercial quantity of dishware. The dishware is conveyed into a wash chamber and simultaneously sprayed from above, below and from the side of the dishware using a sufficient amount of cleaning fluid such that a temperature of at least 155° F. is maintained within the wash chamber of the dishwasher.

18 Claims, 3 Drawing Sheets

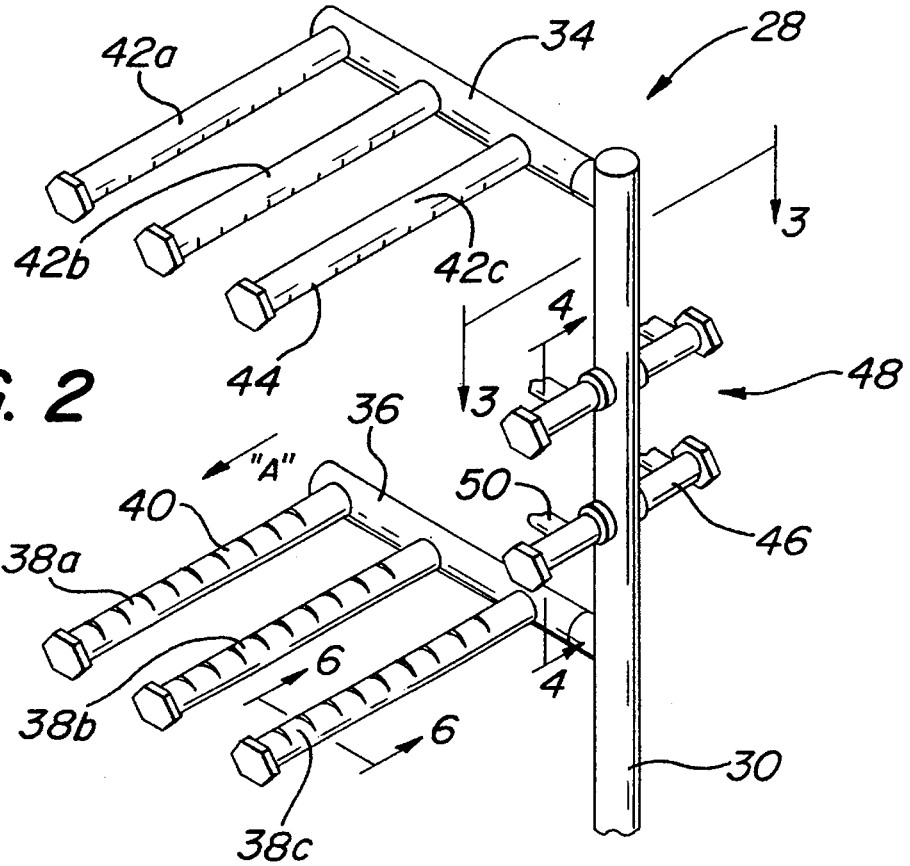
FIG. 2
FIG. 3
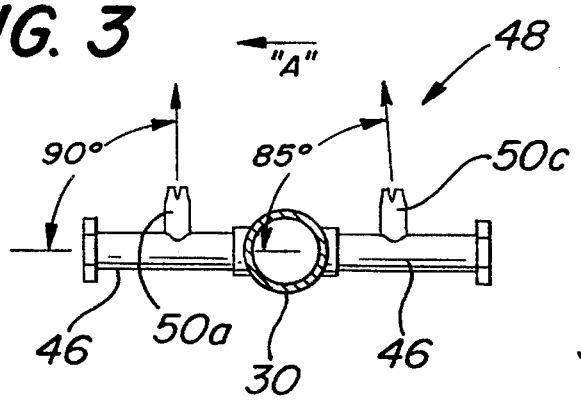
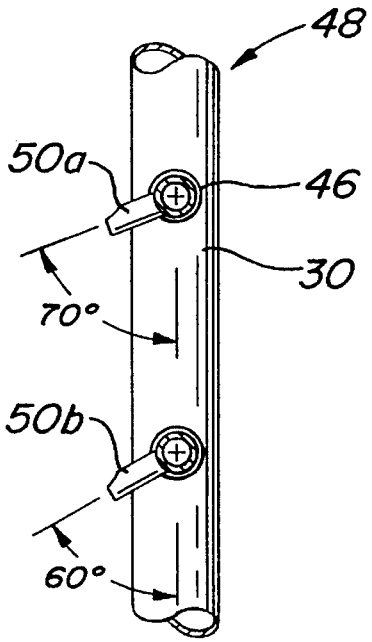
FIG. 4

CONVEYOR DISHWASHER

FIELD OF THE INVENTION

The present invention relates to a dishwasher for cleaning commercial quantities of dishware and, more particularly, the present invention relates to a commercial dishwasher used by the food service industry to achieve maximum cleaning efficiency with a spraying system which directs cleaning fluid from above, below, and to the side of the dishware.

BACKGROUND OF THE INVENTION

The preparation and service of food in commercial quantities is a common task in many institutions. For instance, restaurants, hospitals, schools, prisons and the like, must supply food daily to a relatively large number of people which results in the need for the daily cleaning of a substantial quantity of dishware. Such systems can be expensive to operate.

In the conventional commercial dishwashing system, a rack, or a flight type conveyor having integral compartments, is loaded with a set of dishware. The dishware is then conveyed through a wash chamber. In the wash chamber, cleaning fluid and rinse water are sprayed onto the dishware for the purpose of cleaning the dishware. The dishware exits the dishwasher and is removed from the rack ready for reuse.

A satisfactory dishwashing system must accomplish the goals of cleaning and sanitizing the dishware. As the dishware advances through the wash chamber of the dishwasher, many of the surfaces to be cleaned are shielded from the direct application of a cleaning fluid stream due to the shapes and location in the rack. In addition, corners and crevices on the dishware often further prevent the dishware from being completely cleaned. Spots or streaks on the dishware as it exits the dishwasher indicate that the dishwashing system has failed to meet its goals.

The cleaning function is accomplished by directing as much cleaning fluid as possible toward each single piece of dishware. The greater the area of the dishware that is directly hit by a stream of cleaning fluid, the more likely that all soil will be removed from the dishware. In addition, the more powerful the stream of cleaning fluid, and the greater length of time the stream is directed toward the dishware, the more likely the dishware will be completely cleaned.

The sanitizing function is accomplished by heating a sufficient quantity of the cleaning fluid sprayed on the dishware to a temperature of 155° F. and a sufficient quantity of rinse water to 180° F. Conventionally, the sanitizing function is initiated in a wash zone in the wash chamber and is completed in a rinse zone which may occur separate from the wash chamber. The hot cleaning fluid also helps in the cleaning function, since the soil is more readily removed from the dishware when it is at an elevated temperature.

The designer of a commercially-satisfactory dishwashing system has difficulties in simultaneously accomplishing the cleaning function and initiating the sanitizing function because each has requirements which run counter to the other. For instance, the greater the amount of cleaning fluid sprayed in the wash chamber to accomplish the cleaning function, the greater the heat loss in the wash chamber. Tests have shown that the mist and wind created inside the wash chamber lower the temperature of the cleaning fluid and internal temperature of the wash chamber due to evaporation of cleaning fluid water. To compensate for this heat loss, electric or steam heating elements must be added in the wash chamber to add heat to the recirculating cleaning fluid. Of course, to further heat the cleaning fluid more energy, and fuel cost, must be incurred. Greater water consumption also increases operating costs.

Therefore, a designer of a commercial dishwashing system must take into account several variables which tend to work against each other. The amount of water supplied per a given period of time must be addressed. The temperature to which the cleaning fluid is initially heated and subsequently reheated by heating elements located in the wash chamber affects energy costs and must be addressed. The hydraulic pressure which is applied to the cleaning fluid affects energy costs and must be addressed. The ability to prevent heat dissipation within the wash chamber and the ability to maintain high enough temperatures to initiate sanitizing of the dishware must be addressed. The ability to have a stream of spray which reaches a large portion of the surface of the dishware, the pattern of the spray, and the direction of the spray must be determined. The size and shape of the nozzles, including the size of the apertures, must be determined. A proper combination of the above variables is needed in order to maximize cleaning and sanitizing efficiency, and to minimize the cost while increasing the ease of operation.

U.S. Pat. No. 5,131,419 issued to Roberts illustrates a dishwasher designed for cleaning dishware located on racks. The dishwasher cleans the dishes by spraying fluid from above and below the dishes at a washing temperature of 180° F. At a separate period in the cleaning cycle, the dishwasher cleans utensils, such as forks and spoons, by directing a substantially horizontal spray toward the utensils at a wash temperature of 180° F. The Roberts '419 patent does not suggest simultaneously spraying cleaning fluid from above, below and horizontally across the dishware.

The assignee of the present invention has provided dishwashing equipment with simultaneous cleaning fluid spray from above, below and to the side of the dishware. However, to further advance the art of commercial dishwashing systems, an improved dishwasher is needed which provides a multi-spraying system and which can maintain higher internal wash chamber temperatures and eliminate splashing of cleaning fluid outside of the wash chamber.

Although the aforementioned dishwashers may function satisfactorily for their intended purposes, there is a need for a dishwasher engineered to maximize cleaning efficiency. The dishwasher should be able to direct streams of cleaning fluid simultaneously from above and below the dishware as well as horizontally across the dishware to maximize the cleaning function of the dishwasher. At the same time, the dishwasher should minimize water consumption, spraying and recirculation so as to allow the cleaning fluid and internal wash chamber temperature to remain at or above 155° F. Furthermore, the dishwasher should minimize splashing, should be easy to use, inexpensive to manufacture, and require a minimum of energy to operate.

OBJECTS OF THE INVENTION

With the foregoing in mind, a primary object of the present invention is to provide a commercial dishwasher which can wash and sanitize commercial quantities of dishware efficiently.

Another object of the present invention is to provide a commercial dishwasher, and dishwashing method, which simultaneously applies cleaning fluid to the dishware from above the dishware, below the dishware, and horizontally from the side of the dishware while maintaining cleaning fluid temperature and an internal wash chamber temperature of at least 155° F.

A still further object of the present invention is to provide an improved commercial dishwasher, which utilizes side spray arms to direct cleaning fluid horizontally toward the dishware to remove soil from all corners and crevices of the dishware.

A still further object of the present invention is to provide a unique washing method which minimizes water consumption, maximizes cleaning and sanitizing efficiency, and minimizes energy requirements.

SUMMARY OF THE INVENTION

More specifically, the present invention provides a conveyer-type dishwasher for washing dishware. The dishwasher has a wash chamber with an entrance and an exit through which the dishware is conveyed along a path of travel. Cleaning fluid is supplied to the wash chamber under pressure.

At least one upper spray manifold, at least one lower spray manifold, and a means for providing a side spray are located in the wash chamber. The upper spray manifold directs cleaning fluid toward the dishware from above the path of travel. The lower spray manifold directs cleaning fluid toward the dishware from below the path of travel. The side spray means is located adjacent the path of travel and directs cleaning fluid horizontally toward the dishware from a vertical height which is substantially equal to the dishware's vertical height.

In a first embodiment, the side spray means has at least one downstream spray nozzle aimed substantially perpendicular to the path of travel. The downstream spray nozzle provides a fan-shaped spray pattern and has a predetermined equivalent orifice diameter.

In a second embodiment, the side spray means also has at least one upstream spray nozzle aimed slightly downstream from a perpendicular direction relative to the path of travel. The upstream stray nozzle provides a fan-shaped spray pattern and has a predetermined equivalent orifice diameter.

A method for washing dishware in a commercial conveyer dishwasher is disclosed. The method steps include conveying the dishware into the wash chamber of the dishwasher, spraying cleaning fluid simultaneously inside the wash chamber toward the rack from above, below, and horizontal locations, and maintaining a temperature of at least 155° F. within the confines of the wash chamber during spraying.

DESCRIPTION OF THE DRAWINGS

The foregoing and other objects, features and advantages of the present invention should become apparent in the following description when taken in conjunction with the accompanying drawings, in which:

FIG. 2 is a perspective view of the conduit structure of a dishwasher embodying the present invention;

FIG. 3 is a top cross-sectional plan view of a side spray arm of FIG. 2 taken along line 3—3 thereof;

FIG. 4 is a side cross-sectional elevational view of a side spray arm of FIG. 2 taken along line 4—4 thereof;

DETAILED DESCRIPTION OF PREFERRED EMBODIMENT

Figure 1:
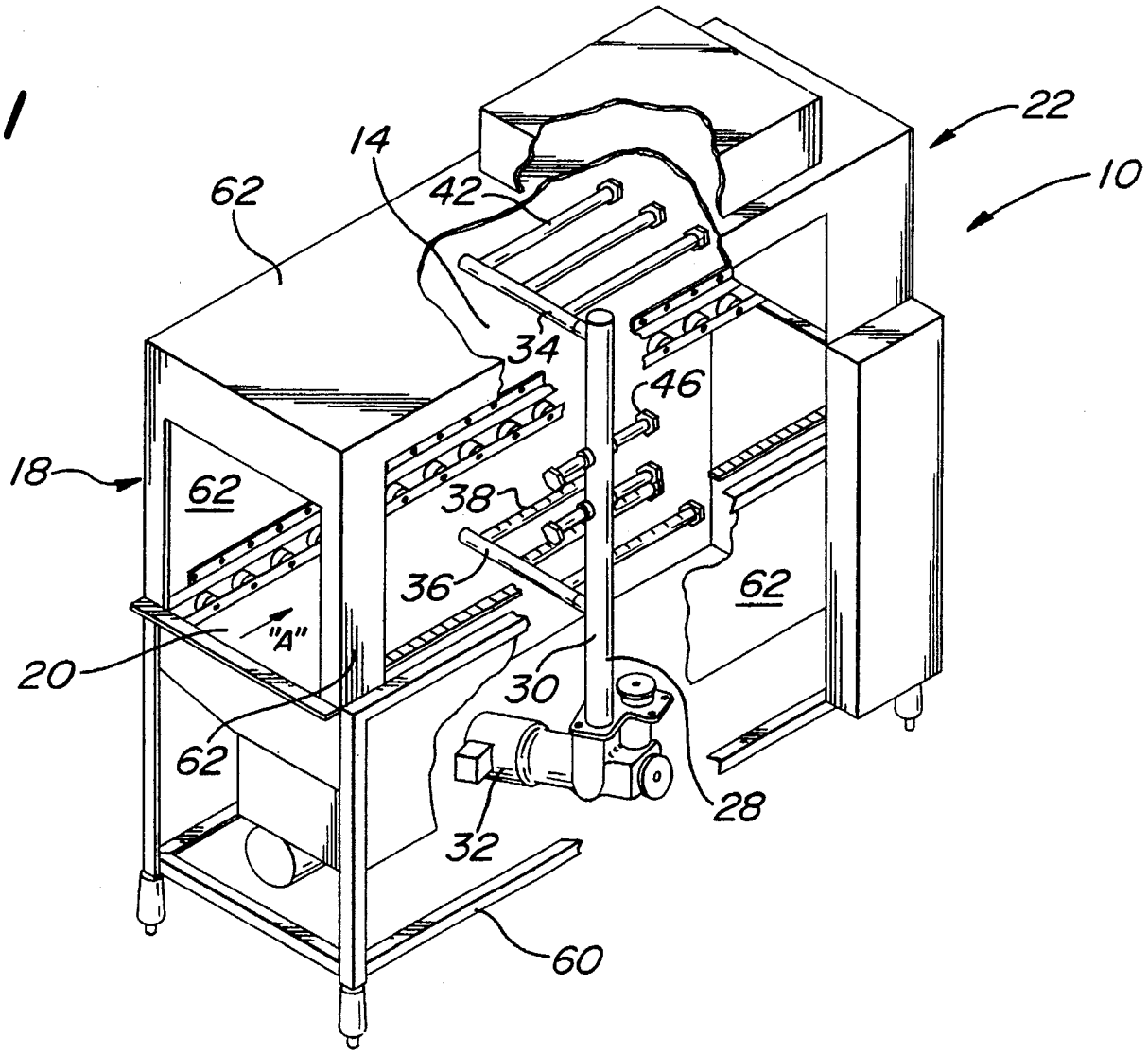
FIG. 1 is a perspective view of a dishwasher embodying the present invention with portions broken-away to expose interior details.

Referring now to the drawings, FIG. 1 illustrates a dishwasher 10 designed to clean and sanitize a commercial quantity of dishware (not shown) in a relatively short period of time. The dishware may include various sized plates, utensils (such as spoons, forks and knives), and various other kitchen items such as bowls, pots and pans.

The dishwasher 10 has a frame 60 which supports the walls 62 of the dishwasher. The walls 62 define a wash chamber 14. The dishwasher 10 also has an entrance 18 and exit 22. The entrance 18 and exit 22 are covered by a series of vertically-hanging plastic strips (not shown).

A conveyor 20 extends through the dishwasher 10. The conveyor 20 begins in front of dishwasher 10 adjacent to the entrance 18. The conveyor 20 defines a path of travel in a direction shown as "A" through the wash chamber 14 and terminates inside the dishwasher 10 adjacent the exit 22. The conveyor 20 has a driving means (not shown) for controlling conveyor movement in conjunction with dishwasher operations.

A relatively large number of items of dishware are placed on a rack (not shown), or directly on a flight type conveyor (not shown) which has compartments for directly retaining the dishware. The rack or flight type conveyor is designed to retain the dishware in a position to maximize the surface exposure of the dishware. The rack or flight type conveyor is placed adjacent the entrance 18. The conveyer structure 20 conveys the dishware through the entrance 18 and into the wash chamber 14. The conveyor 20 subsequently transports the dishware through the exit 22 after the dishware is washed. The plastic strips allow the dishware to enter and exit the wash chamber 14 and aid in preventing splashing of fluid out of the wash chamber 14 during a washing cycle.

Cleaning fluid and rinse water are supplied under pressure to the wash chamber by a conduit system 28 located within the wash chamber 14. The conduit system 28 as shown in FIG. 2 includes a vertical discharge line 30 which connects to a pump 32. The pump 32 supplies a predetermined amount of pressure to the fluid for discharge into the chamber. For the purpose of discharging the cleaning fluid, an upper horizontal discharge line 34 and a lower horizontal discharge line 36 extend horizontally from the vertical discharge line 30. The lower horizontal discharge line 36 extends perpendicular to, and below, the path of travel in a direction "A" of the dishware. The upper horizontal discharge line 34 extends perpendicular to, and above, the dishware path of travel a sufficient amount to allow the dishware to pass underneath the upper horizontal discharge line 34.

Figure 6:
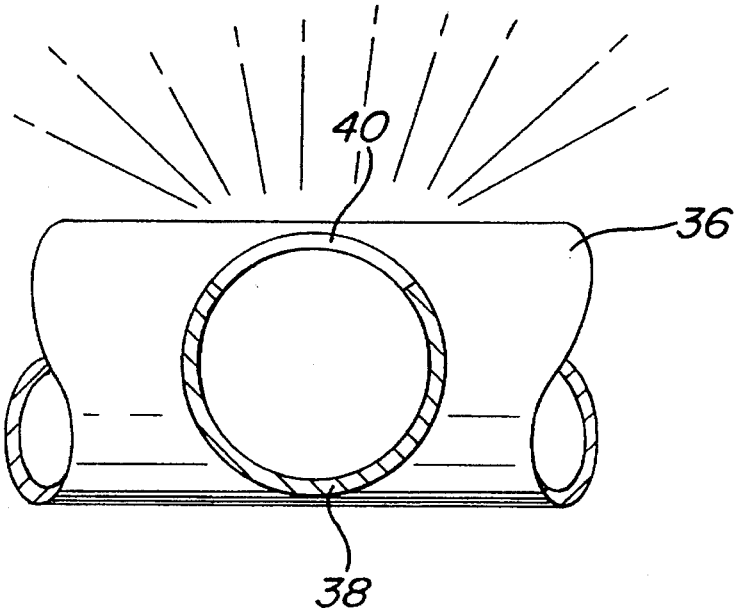
FIG. 6 is a cross-sectional view of FIG. 2 taken along line 6—6.

The lower horizontal discharge line 36 connects to at least one lower spray manifold 38. As illustrated in FIG. 2, a set of three lower spray manifolds, 38*a*, 38*b* and 38*c* are provided. The number of lower spray manifolds may vary, for instance the use of four lower spray manifolds is an alternative. The lower spray manifolds 38 extend parallel to, and beneath, the dishware path of travel. Each lower spray manifold 38 has a series of orifices 40 which direct the cleaning fluid upward toward the dishware. Each orifice 40 provides a fan-shaped spray pattern. See FIG. 6.

The upper horizontal discharge line 34 connects to at least one upper spray manifold 42. As illustrated in FIG. 2, a series of three upper spray manifolds, 42*a*, 42*b* and 42*c* are provided. The number of upper spray manifolds may vary, for instance four upper spray manifolds may be used. The upper spray manifolds 42 extend parallel to, and above, the dishware path of travel at a height sufficient to allow the dishware to be conveyed underneath the upper spray manifolds. Each upper spray manifold 42 has a series of orifices 44 which direct fluid under pressure toward the dishware. Each orifice 44 provides a fan-shaped spray pattern.

The vertical discharge line 30 also connects to a plurality of manifold extensions 46. The manifold extensions 46 extend at about a 90° angle from the discharge line 30 and are adjacent, and parallel to, the path of travel. The manifold extensions 46 are positioned at a vertical height so that they are along the side of the passing dishware.

Figure 5:
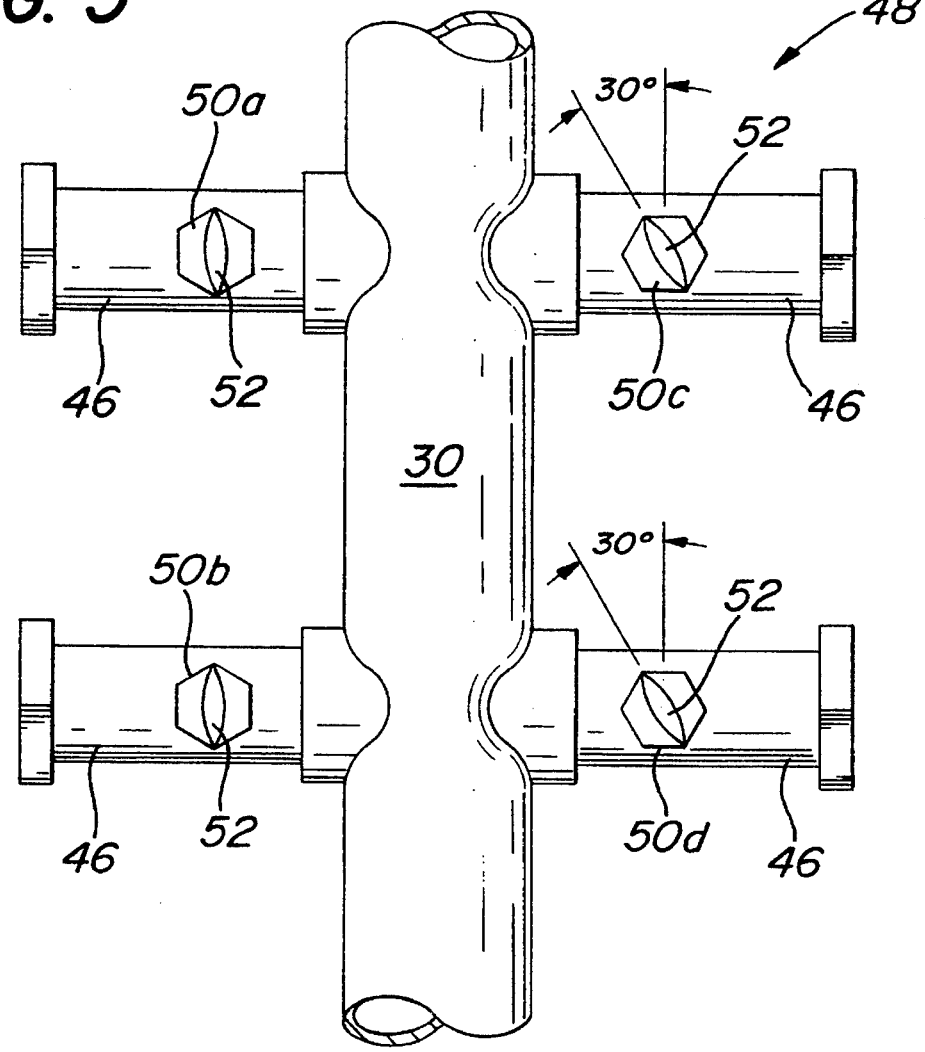
FIG. 5 is a front elevational view of a side spray arm of FIG. 2.

The manifold extensions 46 comprise a side spray means 48. Each manifold extension 46 has a spray nozzle 50. As shown in FIG. 5, the side spray means 48 has an upper downstream spray nozzle 50*a*, a lower downstream spray nozzle 50*b*, an upper upstream spray nozzle 50*c*, and a lower upstream spray nozzle 50*d*. Other embodiments are contemplated. For instance the side spray means 48 may consist only of upper and lower downstream spray nozzles without the use of the upstream spray nozzles. Each of the spray nozzles 50 flows the cleaning fluid substantially horizontally to the dishware traveling in direction "A", and substantially perpendicular to its path of travel through the wash chamber.

The conduit system 28 simultaneously sprays cleaning fluid on a rack containing dishware from above the dishware, from below the dishware, and horizontally adjacent the dishware. This combination of spray generating positions allow a cleaning fluid stream to directly contact a large portion of the surface area of the dishware. The addition of the side spray means 48 allows even shielded corners and crevices of the dishware to be cleaned by the stream of cleaning fluid, and helps to prevent dishware from having spots and streaks after exiting the wash chamber 14 of the dishwasher 10.

A major problem in spraying the dishware with streams of cleaning fluid from above, below, and the side of the dishware is maintaining the temperature of the cleaning fluid and the internal wash chamber temperature at an industry acceptable standard. With the addition of the side spray means, the increased wind turbulence inside the wash chamber tends to decrease cleaning fluid and internal wash chamber temperatures. The side spray means also tends to increase the splash of fluid outside the dishwasher.

To overcome the limitations of simply supplying streams of spray from above, below, and to the side of the dishware, the present invention provides a combination of unique concepts to maximize cleaning efficiency while maintaining acceptable sanitizing results. To this end, the side spray means 48 consists of either four spray nozzles 50*a*, 50*b*, 50*c* and 50*d*, or two spray nozzles 50*a* and 50*b* as previously mentioned. Each spray nozzle 50 provides a fan-shaped spray pattern. For this purpose, each of the spray nozzles 50 has an elliptical orifice 52 shaped to provide the desired fan-shaped spray pattern. To control the amount of fluid discharged by the nozzles 50, each nozzle 50 has an equivalent orifice diameter of between about ¼ and 11/32 inches. This equivalent orifice diameter allows a sufficient amount of side spray to clean the dishware, while preventing an oversupply of side spray which would effectively decrease the inside temperature of the wash chamber as well as the temperature of the cleaning fluid.

As shown on FIG. 5, the elliptical orifice 52 on the upper and lower downstream spray nozzles, 50*a* and 50*b*, are vertically oriented so that the fan spray extends vertically relative to the passing dishware. When used, the elliptical orifice 52 on the upper and lower upstream spray nozzles, 50*c* and 50*d*, are oriented 30° counterclockwise relative to a vertical orientation so that the fan pattern cuts across the dishware. These configurations maximize cleaning efficiency, and minimize heat loss, internal wind currents, and splashing of cleaning fluid outside of the wash chamber.

As shown in FIG. 3, the upper and lower downstream spray nozzles, 50*a* and 50*b* (50*b* not shown), are oriented 90° relative to the manifold extensions 46. Therefore, the vertical orientation of their fan spray pattern cuts perpendicularly across the path of travel of the dishware moving in a direction "A". When used, the upper and lower upstream spray nozzles, 50*c* and 50*d* (50*d* not shown), are directed 5° downstream from a perpendicular direction to the path of travel. This allows the upstream spray nozzles, 50*c* and 50*d*, to aid in pre-washing of the dishware as well as providing extra cleaning to the back of the passing dishware.

As shown in FIG. 4, the upper downstream spray nozzle 50*a* and upper upstream spray nozzle 50*c* (not shown) are directed substantially 20° below the horizontal toward the path of travel. The lower downstream spray nozzle 50*b* and lower upstream spray nozzle 50*d* (not shown) are directed approximately 30° below the horizontal toward the path of travel. The above orientation allows the side spray means 48 to provide coverage over a larger area of dishware and provides the necessary streams to reach most, if not all, of the corners and crevices of the dishware.

The above described dishwasher designs provide a superior cleaning function without limiting its ability to sanitize the dishware. With fluid pressure in a range of 4 to 8 pounds per square inch, the equivalent orifice diameter of the side spray nozzles provides a sufficient amount of fluid, at a sufficient pressure, and stream orientation, to effect maximum cleaning while allowing the internal wash chamber and cleaning fluid temperatures to initiate the sanitizing function.

DETAILED DESCRIPTION OF THE PREFERRED METHOD

The above-described apparatus is particularly suited for use in a method of cleaning a commercial quantity of dishware in a relatively short period of time.

The first step in the method requires stacking a relatively large amount of dishware onto a rack for passage through the dishwasher. The rack is placed adjacent the entrance 18 to the wash chamber 14 and is then conveyed into the wash chamber. Alternately, the dishware is placed directly on a flight type conveyer which has compartments or pegs for receiving the dishware.

cleaning fluid is sprayed simultaneously from above, below and the sides of the dishware. The number of nozzles, the orientation of the nozzles, the spray pattern of the nozzles, and the orifice of the nozzle are as previously described.

The cleaning fluid is sufficient in quantity and energy to clean the dishware. The cleaning fluid pressure is preferably between about 4 to 8 pounds per square inch. The amount of cleaning fluid sprayed from the side spray arm is between about 8 to 35 gallons per minute. The temperature of the cleaning fluid is maintained at about 155° F.

After spraying with the cleaning fluid, the dishware is rinsed with rinse water at sufficient temperature to complete sanitizing of the dishware.

The dishware is then conveyed out an exit of the wash chamber and are in a clean and sanitized condition. The dishware is then ready for reuse.

While a preferred embodiment and method of the present invention has been described in detail, various modifications, alterations, and changes may be made without departing from the sphere and scope of the invention as defined in the appended claims.

We claim:

1. A conveyor-type dishwasher for washing dishware, comprising:

means providing a wash chamber having an entrance and an exit between which the dishware is conveyed along a path of travel;

means for supplying a cleaning fluid at a pre-determined temperature under pressure into said wash chamber means;

at least one upper spray manifold located in said wash chamber means for directing said cleaning fluid toward the dishware from above said path of travel;

at least one lower spray manifold located in said wash chamber means for directing said cleaning fluid toward the dishware from below said path of travel; and side spray means located in said wash chamber means adjacent said path of travel for directing said fluid horizontally toward the dishware from a vertical height which corresponds to the level of the dishware as it advances through said chamber means;

said side spray means having at least one spray nozzle aimed substantially perpendicular to said path of travel;

said at least one spray nozzle providing a fan shaped spray pattern and having an equivalent orifice diameter between about ¼ and 11/32 inches; and said at least one upper spray manifold, said at least one lower spray manifold, and said side spray means simultaneously directing said cleaning fluid toward the dishware in a manner which provides a temperature inside said wash chamber means approximately equal to said cleaning fluid pre-determined temperature.

2. A conveyer-type dishwasher according to claim 1, wherein said side spray means has an upper and lower spray nozzle.

3. A conveyer-type dishwasher according to claim 2, wherein said upper spray nozzle is directed about 20° downward from the horizontal.

4. A conveyer-type dishwasher according to claim 3, wherein said lower spray nozzle is directed about 30° downward from the horizontal.

5. A conveyer-type dishwasher according to claim wherein said upper and lower spray nozzles provide a fan shaped spray pattern which is vertically oriented.

6. A conveyer-type dishwasher according to claim 1, further comprising a vertical discharge line located in said wash chamber means adjacent said path of travel and connected to said fluid supply means.

7. A conveyer-type dishwasher according to claim 6, wherein said side spray means has a manifold extension connecting said vertical discharge line to said at least one spray nozzle.

8. A conveyer-type dishwasher according to claim 7 further comprising an upper horizontal discharge line connecting said vertical discharge line to said at least one upper spray manifold, and further comprising a lower horizontal discharge line connecting said vertical discharge line to said at least one lower spray manifold.

9. A conveyor-type dishwasher for washing dishware, comprising:

means providing a wash chamber having an entrance and an exit between which the dishware is conveyed along a path of travel;

means for supplying a cleaning fluid at a pre-determined temperature under a pressure of between about 4 to 8 pounds per square inch into said wash chamber means;

at least one upper spray manifold located in said wash chamber means for directing said cleaning fluid toward the dishware from above said path of travel;

at least one lower spray manifold located in said wash chamber means for directing said cleaning fluid toward the dishware from below said path of travel; and side spray means located in said wash chamber means adjacent said path of travel for directing said fluid horizontally toward the dishware from a vertical height which corresponds to the level of the dishware as it advances through said chamber means;

said side spray means having at least one downstream spray nozzle and at least one Upstream spray nozzle, said downstream spray nozzle located downstream said path of travel relative to said upstream spray nozzle, said at least one downstream spray nozzle aimed substantially perpendicular to said path of travel, and said at least one upstream spray nozzle aimed slightly downstream from a perpendicular direction relative to said path of travel;

said at least one downstream spray nozzle and said at least one upstream spray nozzle providing a fan shaped spray pattern and having an equivalent orifice diameter between about ¼ and 11/32 inches; and said at least one upper spray manifold, said at least one lower spray manifold, and said side spray means simultaneously directing said cleaning fluid toward the dishware at said pressure which maintains a temperature inside said wash chamber means approximately equal to said pre-determined temperature of said cleaning fluid.

10. A conveyer-type dishwasher according to claim 9, wherein said at least one upstream spray nozzle is aimed about 5° downstream from a perpendicular direction relative to said path of travel.

11. A conveyer-type dishwasher according to claim 10, wherein said side spray means has an upper and lower downstream spray nozzle and an upper and lower upstream spray nozzle.

12. A conveyer-type dishwasher according to claim 11, wherein said upper downstream spray nozzle and said upper upstream spray nozzle are directed about 20° downward from the horizontal.

13. A conveyer-type dishwasher according to claim 12, wherein said lower downstream spray nozzle and said lower upstream spray nozzle are directed about 30° downward from the horizontal.

14. A conveyer-type dishwasher according to claim 13 wherein said upper and lower downstream spray nozzles provide a fan shaped spray pattern which is vertically oriented.

15. A conveyer-type dishwasher according to claim 14, wherein said upper and lower upstream spray nozzles provide a fan shaped spray pattern offset about 30° counterclockwise from a vertical orientation.

16. A conveyer-type dishwasher according to claim 9, further comprising a vertical discharge line located in said wash chamber means adjacent said path of travel and connected to said fluid supply means.

17. A conveyer-type dishwasher according to claim 16, wherein said side spray means has a plurality of manifold extensions connecting said vertical discharge line to said at least one downstream spray nozzle and at least one upstream spray nozzle.

18. A conveyer-type dishwasher according to claim 17 further comprising an upper horizontal discharge line connecting said vertical discharge line to said at least one upper spray manifold, and further comprising a lower horizontal discharge line connecting said vertical discharge line to said at least one lower spray manifold.

* * * * *

UNITED STATES PATENT AND TRADEMARK OFFICE

CERTIFICATE OF CORRECTION

PATENT NO. : 5,497,798

DATED : March 12, 1996

INVENTOR(S) : Herbert D. Fritz and Austin H. Rosenblum

It is certified that error appears in the above-indentified patent and that said Letters Patent is hereby corrected as shown below:

Column 6, line 57, "cleaning" should be corrected to read --Cleaning--;

Column 7, line 54, after "claim" should be inserted --4--.

Signed and Sealed this

Eighteenth Day of June, 1996

Bruce Lehman

*Attest:*

BRUCE LEHMAN

*Attesting Officer*

*Commissioner of Patents and Trademarks*